US010618337B2

(12) United States Patent
Rome

(10) Patent No.: US 10,618,337 B2
(45) Date of Patent: Apr. 14, 2020

(54) FLEXIBLE AND DURABLE BOOKBINDING

(71) Applicant: WOODPECKER LABORATORIES, LLC, Nyack, NY (US)

(72) Inventor: Zachary Rome, Nyack, NY (US)

(73) Assignee: WOODPECKER LABORATORIES, LLC, Nyack, NY (US)

( * ) Notice: Subject to any disclaimer, the term of this patent is extended or adjusted under 35 U.S.C. 154(b) by 0 days.

(21) Appl. No.: 16/132,546

(22) Filed: Sep. 17, 2018

(65) Prior Publication Data

US 2019/0084335 A1 Mar. 21, 2019

Related U.S. Application Data

(60) Provisional application No. 62/559,815, filed on Sep. 18, 2017.

(51) Int. Cl.

| | |
|---|---|
| ***B42D 1/06*** | (2006.01) |
| ***B42F 13/06*** | (2006.01) |
| ***B42D 3/04*** | (2006.01) |
| ***B42D 3/02*** | (2006.01) |
| ***B42D 3/18*** | (2006.01) |
| ***B42B 5/08*** | (2006.01) |
| ***B42D 3/12*** | (2006.01) |
| ***B42B 5/04*** | (2006.01) |
| ***B42D 1/00*** | (2006.01) |
| ***B42D 3/00*** | (2006.01) |

(52) U.S. Cl.

CPC ..... *B42D 3/04* (2013.01); *B42B 5/04* (2013.01); *B42B 5/08* (2013.01); *B42D 1/004* (2013.01); *B42D 1/06* (2013.01); *B42D 3/002* (2013.01); *B42D 3/02* (2013.01); *B42D 3/12* (2013.01); *B42D 3/18* (2013.01); *B42F 13/06* (2013.01); *B42P 2241/04* (2013.01); *B42P 2241/28* (2013.01)

(58) Field of Classification Search

CPC ..... B42D 1/06; B42D 3/002; B42F 13/06
USPC ..... 281/23, 24
See application file for complete search history.

(56) References Cited

U.S. PATENT DOCUMENTS

| | | | | |
|---|---|---|---|---|
| 467,892 | A * | 1/1892 | Ogden | B42F 11/02 281/24 |
| 1,526,533 | A * | 2/1925 | D'Eggis | B42F 11/00 281/23 |
| 1,995,596 | A * | 3/1935 | Adamson | B42D 1/06 281/23 |
| 2,329,786 | A * | 9/1943 | Ringler | B42F 13/02 402/8 |
| 4,375,925 | A * | 3/1983 | Grummich | B42D 1/08 281/23 |
| 5,683,111 | A | 11/1997 | Bass et al. | |
| 6,186,690 | B1 * | 2/2001 | Duncan | B42F 13/06 281/21.1 |
| 6,669,392 | B2 * | 12/2003 | Rebora | B42B 5/103 281/21.1 |
| 6,712,396 | B2 | 3/2004 | Derraugh | |

(Continued)

*Primary Examiner* — Kyle R Grabowski
(74) *Attorney, Agent, or Firm* — Dilworth IP, LLC

(57) ABSTRACT

The present invention relates to a flexible and durable bookbinding and to methods for making bound books. More specifically, the present invention relates to books that may withstand substantial and repeated perpendicular flexure along their spine. Among other advantages, these books demonstrate improved resistance to wear and tear and normal usage to remain intact.

9 Claims, 12 Drawing Sheets

(56) References Cited

U.S. PATENT DOCUMENTS

| | | | |
|---|---|---|---|
| 8,870,228 | B2 | 10/2014 | No et al. |
| 9,499,003 | B2 | 11/2016 | Huotari et al. |
| 9,713,934 | B2 | 7/2017 | Frison |

* cited by examiner

FLEXIBLE AND DURABLE BOOKBINDING

FIELD OF THE INVENTION

The present invention relates to a flexible and durable bookbinding and to methods for making bound books. More specifically, the present invention relates to books that may withstand substantial and repeated perpendicular flexure along their spine. Among other advantages, these books demonstrate improved resistance to wear and tear and normal usage to remain intact.

BACKGROUND OF THE INVENTION

Bookbinding is the process of physically assembling and combining a plurality of sheets. It dates back thousands of years and is used every day in the creation of books, magazines, notebooks, albums, and manuals, among other examples. Several different methods or types of bookbinding have been developed. Which type of binding is preferred or employed depends on various factors of the project, including but not limited to, cost, size, aesthetics, and functionality. Some, but not all, aspects of functionality that are important to a user of a book are if the book can open flat (i.e. open to reveal the full area of the sheet), how many sheets the book can hold, if the sheets are permanently bound or if they can be removed and replaced, if the book is convenient to carry around, if the sheets can be rotated completely around the spine, and if the book is durable, i.e. how well it can withstand the "wear-and-tear" of its intended use. A description of current bookbinding types is explained below.

Saddle stitched is a common method whereby a wire or series of wires (e.g. a series of staples) are punched through a book's outside spine and then bent flat to grip a group of sheets that are folded around the wire or wires. This method is cost effective; however, it cannot easily bind many sheets, the sheets are permanently bound, and the sheets cannot rotate completely around the spine. Stab stitched or side stitched uses a wire or thread that is inserted into the front cover, through the sheets, and out of the back cover instead of along the spine. This method is cost effective; however, the sheets cannot open flat, the sheets are permanently bound, and the sheets cannot rotate completely around the spine. Sewn bound is similar to saddle stitched, but it is sewn with a thread instead of a wire. This method is aesthetically preferred by some; however, it is costly, it cannot easily bind many sheets, the sheets are permanently bound, and the sheets cannot rotate completely around the spine. Perfect bound is a method whereby different sections of folded sheets (called signatures) are grouped together along each section's folded side and glued to a cover. This method is cost effective; however, the sheets cannot open flat, the sheets are permanently bound, and the sheets cannot rotate completely around the spine. Hardcover or case bound typically involves signatures being sewn together and then glued to a cover. This method can bind many pages; however, it is expensive, the sheets cannot open flat, the sheets are permanently bound, and the sheets cannot rotate completely around the spine. Ring bound is a method whereby a ring or a series of rings is looped through a hole or a series of holes in a group of sheets in a manner where the ring can be either permanently connected or temporarily connected and opened on demand by a user. This method can be cost effective; however, the ring or rings—being not flush with the book—can be obtrusive and are prone to damage. Spiral bound is a method whereby a smooth round coil is looped through holes in the sheets to hold them together. This method is cost effective; however, the sheets are permanently bound, the coil—being rigid and not flush with the book—can be obtrusive, and the coil can easily get bent or otherwise damaged.

Additionally, all of the current types of bookbinding have common issues and inadequacies. As just one example, all of the current options have spines that are inflexible or will damage the sheets or the binding upon perpendicular (i.e. horizontal) flexure. This can be undesirable for many reasons. As just one example, it is common that people carry their book (e.g. a notebook or a pocket sized paperback book) in their back pocket, and carrying a book bound with the current methods in one's back pocket will cause discomfort to the carrier and/or damage to the book through the normal flexures involved in walking and sitting, among other everyday motions. As another example, certain preferred shipping rates and options offered by the United States Postal Service require that the shipment be flexible (in this instance meaning at least one inch of flexibility in each dimension) and uniformly thick (in this instance meaning that the item cannot have more than a ¼ inch variance in thickness). The inflexible spine and/or non-uniform thickness prevent most books bound by these methods from qualifying for these preferred shipping options.

Therefore, despite the long history and many different types of bookbinding, there remains a need for improved bookbinding methods or types. In particular, there is a need for a cost-effective type of bookbinding that provides for perpendicular flexure of the spine without damaging the binding or sheets. Additionally, it may be beneficial in certain applications that a book with such binding is uniform in thickness, comfortable and convenient to carry around (e.g. to carry in one's back pocket), provides for removable or replaceable sheets, can open flat, can bind many sheets, provides for sheets that do not have to be folded, provides for sheets to rotate completely around the spine, is aesthetically pleasing, can be produced in a variety of sizes and shapes, and is durable. The invention of this application presents the first such technology that can provide all of these benefits.

SUMMARY OF THE INVENTION

The present invention relates, in certain embodiments, to improved methods and types of bookbinding. These types are useful for providing books that have a spine capable of withstanding substantial and repeated perpendicular flexure without damaging the binding or sheets. Furthermore, the bookbinding methods and types of the present invention can provide for a book that is uniform in thickness, more comfortable and convenient to carry around (e.g. to carry in one's back pocket), capable of removing and/or replacing sheets, can open flat, can bind many sheets, provides for sheets that do not have to be folded, provides for sheets to rotate completely around the spine, is aesthetically pleasing, can be produced in a variety of sizes and shapes, and is durable.

The present invention is based on a system whereby one or more flexible strips are affixed to the front and back covers of a book and threaded through a space or spaces in the sheets such that such strip or strips thereby bind the sheets and covers together. In some embodiments, the strip may also thread through a space in the front cover. In other embodiments, the strip may thread through a sleeve or space on the inside of the front cover. In still further embodiments, the strip may thread through a space in the front cover and wrap around the front cover and be affixed to the back cover to ensure a secure closure of the book.

This system of combining sheets does not require that the sheets are folded, i.e. the sheets do not need to be folded prior to binding or upon completion of the binding. It also does not require any metal, glue, cardboard, or other rigid materials that may irreparably bend, snap, rust, weaken, or deteriorate by any other means. Thereby, a book bound by this technology will be capable of withstanding substantial and repeated flexure in any direction without damage to the binding or sheets. Further, a book bound by this technology will be simpler to make and involve less material and costs than conventional books.

The method and type of bookbinding described herein can be useful for and used to create many types of books, including, but not limited to, novels, notebooks, manuals, albums, and magazines. Additionally, the technology of the present invention can be used to create books from many different materials. Materials that can be used to create the covers include, but are not limited to, various types of leather, cloth, fabric, cardboard, and plastic. Materials that can be used to create the sheets that can be bound via the technology of the present invention include, but are not limited to, various types of paper (including synthetic papers and stone papers), photographs, and plastic. Materials that can be used to create the strips include, but are not limited to, various types of leather, cloth, fabric, elastic, nylon, paper (including synthetic papers and stone papers), plastic, and rubber (including synthetic rubber).

To make a book with the technology of the present invention, one or more flexible strips are affixed to the inside of the back cover. This may be accomplished using several different methods including, but not limited to, using a flexible adhesive such as tape or glue. The strip or strips are then threaded through coordinated spaces in the sheets and affixed to the front cover. This may be accomplished by using several different methods including, but not limited to, using a flexible adhesive such as tape or glue. Another method of affixing the strip to the front cover may be to thread the strip through a sleeve or sleeves on the inside of the front cover. Yet another method of affixing the strip to the front cover may be to thread the strip through a coordinated space in the front cover. In some embodiments, the open end of the strip or strips are then made to either permanently or temporarily secure the front cover and bind the sheets together. This may be accomplished by using several different methods including, but not limited to, having the strip or strips widen in width such that they can no longer slip through the space or sleeve in the front cover and/or having the strip or strips wrap around the front cover and affix to the back cover.

DETAILED DESCRIPTION OF THE INVENTION

Figure 1:
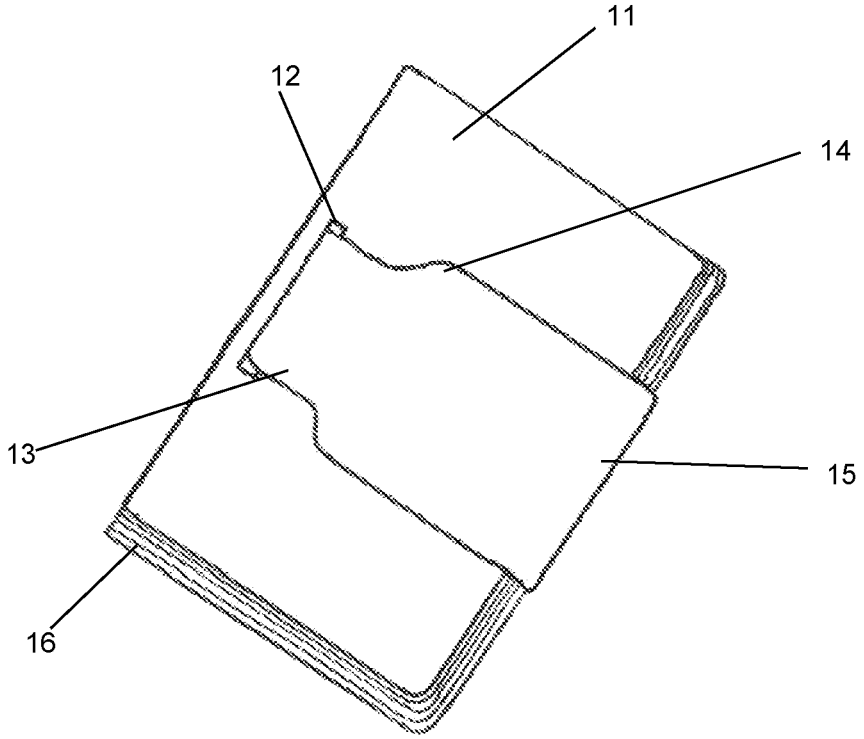
FIG. 1 shows the outside of the front cover of a book bound by a certain embodiment of the present invention.

The present invention relates to methods and types of bookbinding. In certain embodiments, one or more flexible strips are affixed to the front and back covers of a book and threaded through a space or spaces in the sheets such that such strip or strips thereby bind the sheets and covers together. In some embodiments, the strip may also thread through a space in the front cover. In certain other embodiments, the strip may thread through a sleeve or space on the inside of the front cover.

The present invention relates to a book comprising:

(a) a front cover having an inner surface and an outer surface;

(b) a rear cover having an inner surface and an outer surface;

(c) one or more flexible strips;

(d) one or more interior sheets; and (e) an optional spine;

wherein, (i) the one or more interior sheets each comprises one or more apertures [or slits], such that the one or more apertures [or slits] are each identically oriented on each sheet; and (ii) the one or more flexible strips are in length, between where they are secured at the front and back covers, from about 2 times to about 25 times the thickness of the compiled interior sheets, each strip is threaded through and moves freely through each identically oriented group of apertures [or slits] of the one or more sheets, and wherein each flexible strip is secured at one end to the inner surface of the front cover and at the opposite end of the strip to the inner surface of the rear cover.

In other embodiments, the present invention relates to a book comprising a single flexible strip, wherein the one or more interior sheets each comprises a single aperture [or slit], such that the single aperture [or slit] is identically oriented on each sheet.

In other embodiments, the present invention relates to a book wherein the flexible strips are in length, between where they are secured at the front and back covers, from about 3 times to about 15 times the thickness of the compiled interior sheets.

In other embodiments, the present invention relates to a book wherein the flexible strips are in length, between where they are secured at the front and back covers, from about 4 times to about 10 times the thickness of the compiled interior sheets.

In other embodiments, the present invention relates to a book wherein the one or more flexible strips each comprises one or more folds [or creases], which when the book is opened are oriented at a 90 degree angle to the longitudinal direction of each strip and the one or more folds [or creases] are identically positioned and oriented on each strip.

In other embodiments, the present invention relates to a book that is a flexible book.

In other embodiments, the present invention relates to a book wherein the front cover is a flexible front cover and wherein the rear cover is a flexible rear cover.

In other embodiments, the present invention relates to a book wherein the optional spine is an optional flexible spine.

In other embodiments, the present invention relates to a book comprising:

(a) a front cover having an inner surface and an outer surface;

(b) a rear cover having an inner surface and an outer surface;

(c) one or more flexible strips;

(d) one or more interior sheets; and (e) an optional spine;

wherein, (i) the one or more interior sheets each comprises one or more apertures [or slits], such that the one or more apertures [or slits] are each identically oriented on each sheet;

(ii) the front cover comprises one or more apertures [or slits] each identically oriented with respect to the one or more apertures [or slits] on each sheet; and (iii) the one or more flexible strips is each threaded through and moves freely through each identically oriented group of apertures [or slits] of the one or more sheets, one end of the flexible strip is threaded through the front cover, and other end of the flexible strip is secured to the inner surface of the rear cover.

In other embodiments, the present invention relates to a book wherein the end of each of the flexible strips that is threaded through the front cover comprises a locking tab.

In other embodiments, the present invention relates to a book wherein the end of each of the flexible strips that is threaded through the front cover comprises a means for wrapping around and releasably securing to the rear cover.

In other embodiments, the present invention relates to a book wherein the means for wrapping around and releasably securing to the rear cover is an elastic means.

In other embodiments, the present invention relates to a book wherein the means for wrapping around and releasably securing to the rear cover comprises a multitude of miniature hooks and loops such as a Velcro fastener.

In other embodiments, the present invention relates to a book comprising a single flexible strip, wherein the one or more interior sheets each comprises a single aperture [or slit], such that the single aperture [or slit] is identically oriented on each sheet.

In other embodiments, the present invention relates to a book wherein the end of the flexible strip that is threaded through the front cover comprises a locking tab.

In other embodiments, the present invention relates to a book wherein the end of the flexible strip that is threaded through the front cover comprises a means for wrapping around and releasably securing to the rear cover.

In other embodiments, the present invention relates to a book wherein the means for wrapping around and releasably securing to the rear cover is an elastic means.

In other embodiments, the present invention relates to a book wherein the means for wrapping around and releasably securing to the rear cover comprises a multitude of miniature hooks and loops such as a Velcro fastener.

In other embodiments, the present invention relates to a book comprising:

(a) a front cover having an inner surface and an outer surface;

(b) a rear cover having an inner surface and an outer surface;

(c) one or more flexible strips;

(d) one or more interior sheets; and (e) an optional spine;

wherein, (i) the one or more interior sheets each comprises one or more apertures [or slits], such that the one or more apertures [or slits] are each identically oriented on each sheet;

(ii) the front cover comprises an inner layer, an outer layer, and a space between the inner layer and the outer layer, wherein the inner layer of the front cover comprises one or more apertures [or slits] each identically oriented with respect to the one or more apertures [or slits] on each sheet; and (iii) the one or more flexible strips is each threaded through and moves freely through each identically oriented group of apertures [or slits] of the one or more sheets, one end of the flexible strip is threaded through the inner layer of the front cover, and other end of the flexible strip is secured to the inner surface of the rear cover.

In other embodiments, the present invention relates to a book wherein the end of each of the flexible strips that is threaded through the inner layer of the front cover comprises a locking tab.

In other embodiments, the present invention relates to a book comprising a single flexible strip, wherein the one or more interior sheets each comprises a single aperture [or slit], such that the single aperture [or slit] is identically oriented on each sheet.

In other embodiments, the present invention relates to a book wherein the end of the flexible strip that is threaded through the inner layer of the front cover comprises a locking tab.

Figure 2:
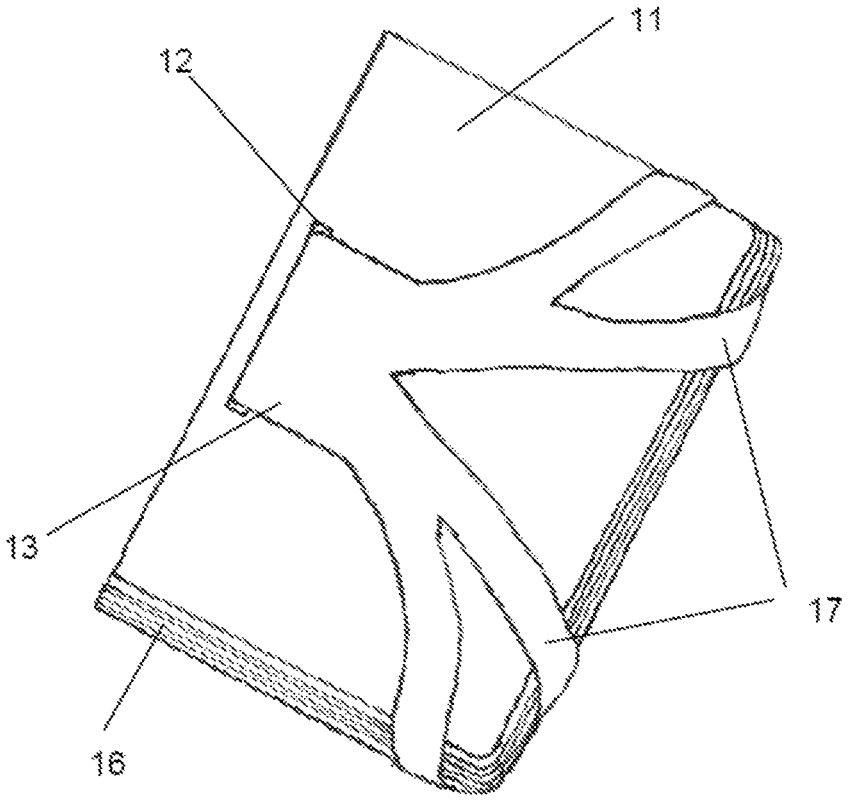
FIG. 2 shows the outside of the front cover of a book bound by a certain embodiment of the present invention.
Figure 3:
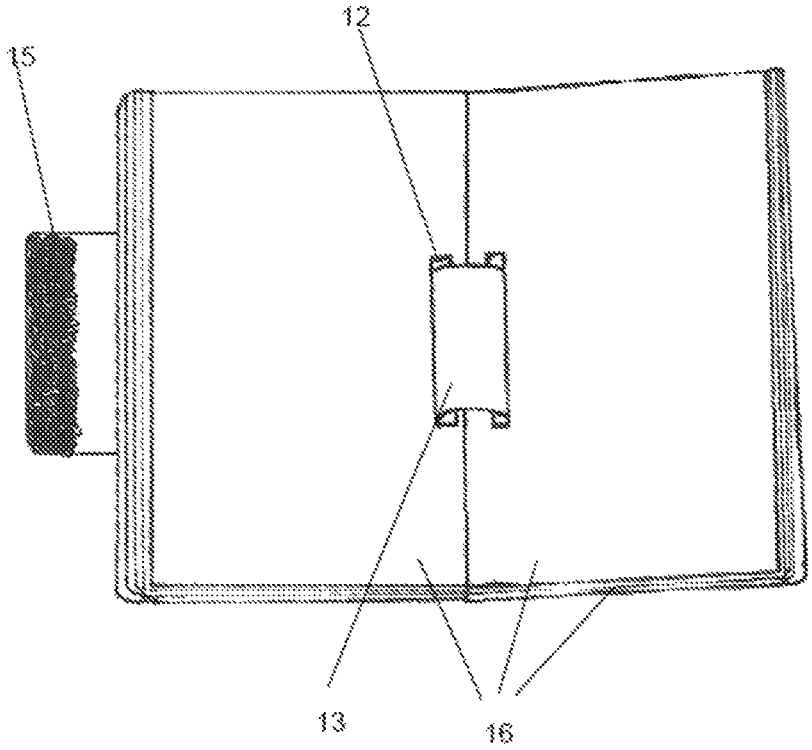
FIG. 3 shows the inside of a book bound by a certain embodiment of the present invention.
Figure 4:
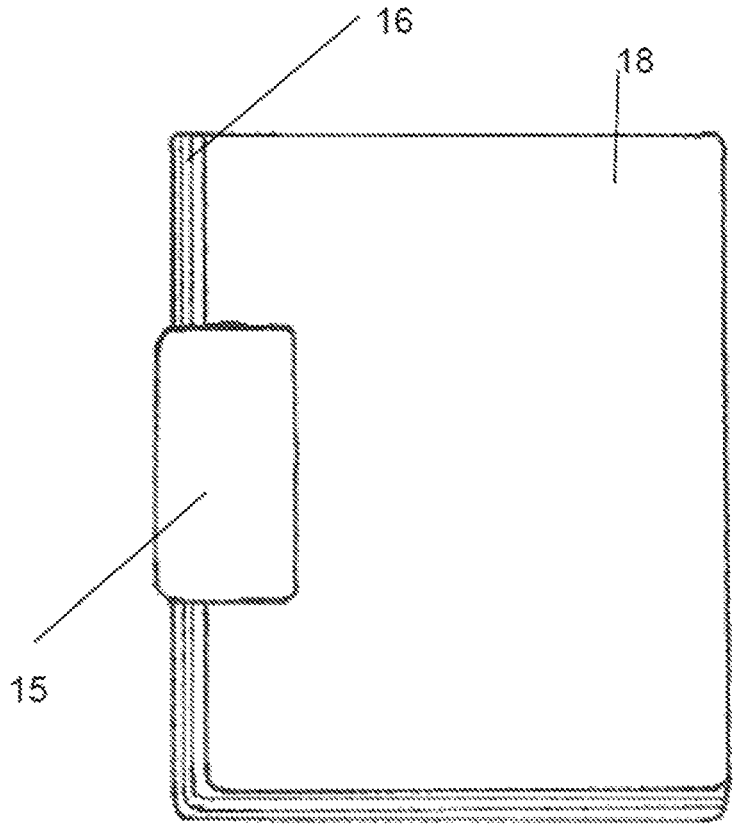
FIG. 4 shows the outside of the back cover of a book bound by a certain embodiment of the present invention.

FIG. 1 shows the outside of the front cover of a book bound by a certain embodiment of the present invention. A flexible strip 13 is threaded through a space 12 in the sheets 16 and front cover 11 thereby binding the sheets and covers together. In certain embodiments, the strip or strips can wrap around the front cover and be affixed to the back cover to ensure a secure closure of the book. This can be accomplished by several different methods including, but not limited to, using Velcro®, a button or buttons, magnets, a string or cord, a clasp, or an elastic, among many other types of fasteners. For example, as can be seen in FIGS. 1, 3, and 4, the strip 13 wraps around the front cover 11 and attaches to the back cover 18 via a Velcro patch on the underside of the strip 15. This feature can be accomplished by incorporating many different designs, as well. For example, as can be seen in FIG. 2, the strip 13 can taper into two loops 17 that can wrap around the corners of the front and back covers to secure closure of the book. In another embodiment, there can be a notch in the front cover, sheets, and/or back cover by which the strip could attach. These illustrations are only meant to serve as examples and do not represent the full potential of designs.

FIG. 3 shows the inside of a book bound by the embodiment represented by FIGS. 1 and 4. The strip 13 is threaded through the space 12 in each of the sheets 16 to bind them together. The Velcro patch on the underside of the strip 15 is exposed. FIG. 4 shows the outside of the back cover of this embodiment after the Velcro patch on the underside of the strip 15 has been affixed to the back cover 18.

In certain embodiments, it is not necessary that the strip wrap around the front cover and affix to the back cover. In another aspect, after being threaded through the front cover, the strip can attach to the outside of the front cover. This can be accomplished by several different methods including, but not limited to, using Velcro, a button or buttons, magnets, a string or cord, a clasp, or an elastic, among many other types of fasteners. In another aspect, after being thread through the front cover, the strip can attach to an item or fastener that is not affixed to the front cover. In another aspect, after being thread through the front cover, the strip can be made to prevent itself from slipping back through the space and serve as the completion of the binding itself. FIG. 1 represents just one example for how this can be accomplished, whereby the strip 13 widens in thickness and/or width 14 such that it can no longer slip through the space 12 in the sheets 16 and front cover 11. Another example for how this can be accomplished is by simply rolling the strip together and causing it to stay affixed in the rolled position by using, as just some examples, Velcro, a button, or a clasp. This mechanism, whereby the strip is made to prevent itself from slipping back through the space in the sheets, can be incorporated into other embodiments as well, including embodiments where the strip is not thread through the front cover.

Figure 7:
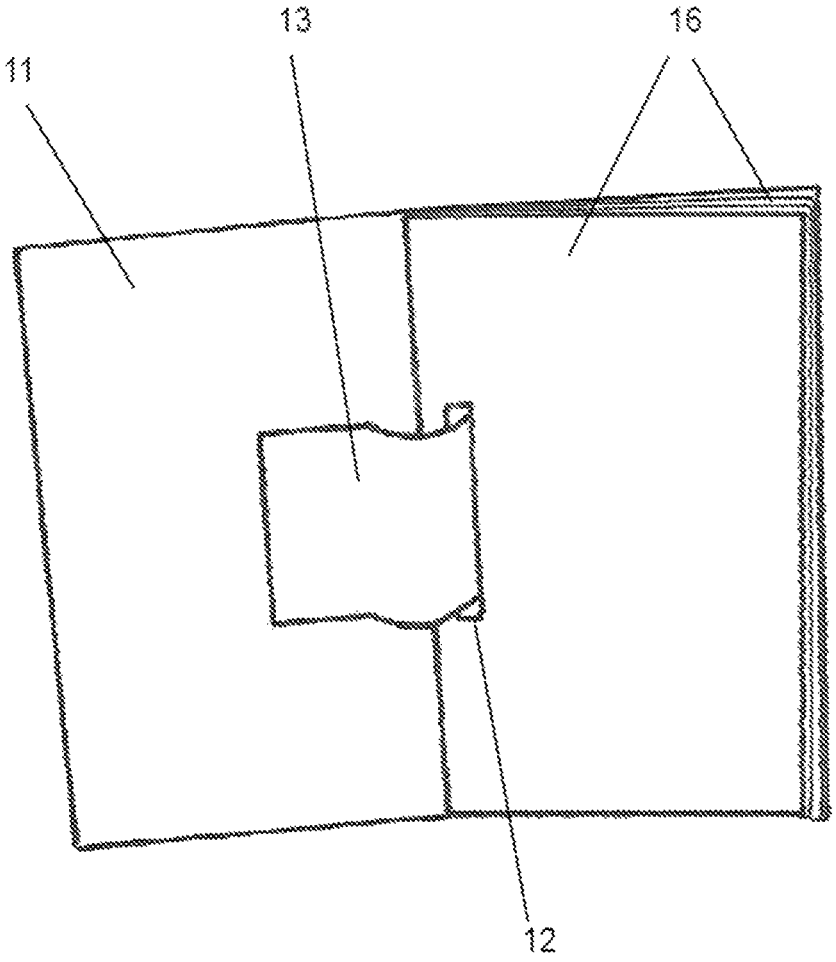
FIG. 7 shows the inside of the front cover of a book bound by a certain embodiment of the present invention.
Figure 8:
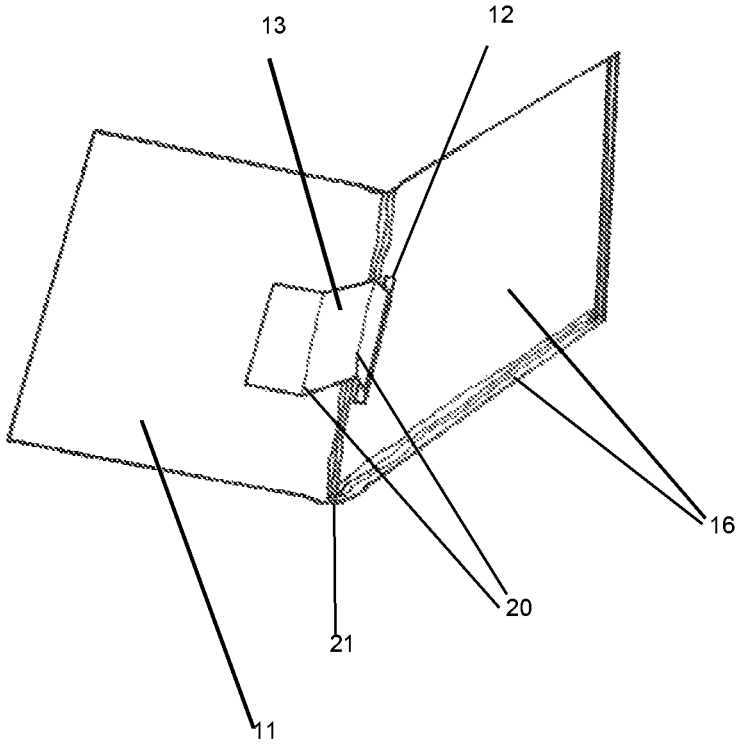
FIG. 8 shows the inside of the front cover of a book bound by a certain embodiment of the present invention.
Figure 9:
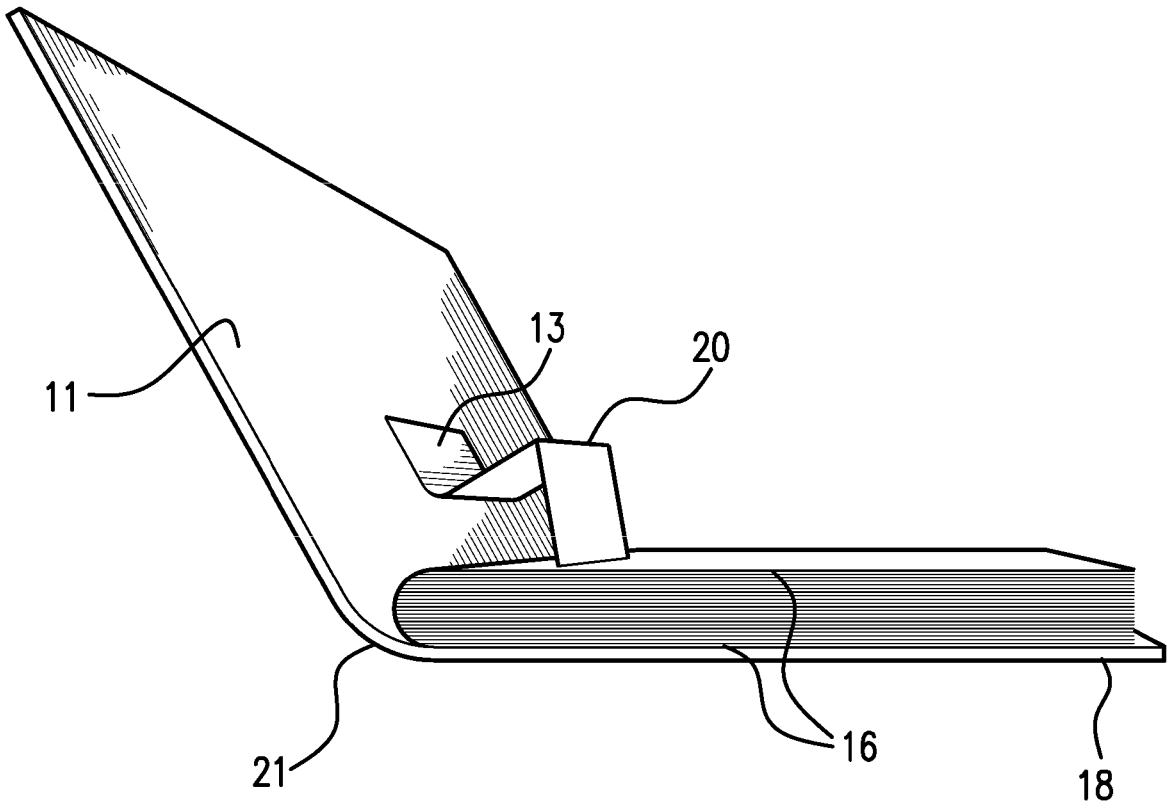
FIG. 9 shows an elevated view of the inside of the front cover of a book bound by a certain embodiment of the present invention.

In yet another embodiment of the invention, the strip does not need to thread through the front cover, but can affix to the inside of the front cover after having been thread through the sheets. In some embodiments, the strip can be temporarily affixed to the inside of the front cover, and in other embodiments the strip can be permanently affixed. FIG. 7 shows the inside of the front cover of an embodiment where the strip is affixed directly to the inside of the front cover. After being thread through the space 12 in the sheets 16, the strip 13 is attached directly to the inside of the front cover 11. In some aspects, the strip will be pre-folded such that it can fold neatly together upon opening and closing of the book. In other aspects, upon closure of the book, the strip may neatly fold between the last two pages that were open and serve as a bookmark. These features are illustrated in FIGS. 8 and 9. FIG. 8 shows an embodiment where the strip 13 is threaded through a space 12 in the sheets 16 and affixed to the inside of the front cover 11. A spine 21 attaches the front and back covers. It can be seen that the strip 13 is folded in two areas 20 that allow for any slack from the strip to be neatly and consistently organized to allow for the book to be easily and smoothly opened and closed. Further, upon opening of the book, these folds create an elevated space between the strip 13 and the spine 21 to more easily allow the sheets to be flipped backward and forward during use. FIG. 9 shows an elevated view of the same embodiment of the book as FIG. 8. The strip 13 is affixed to the back cover 18 and threaded through the sheets 16 and attached to the front cover 11. A spine 21 attaches the front and back covers. The fold 20 creates an elevated space between the strip 13 and the spine 21 to allow the pages to be flipped more easily and smoothly. The fold also neatly organizes the strip to improve opening and closing of the book.

Figure 5:
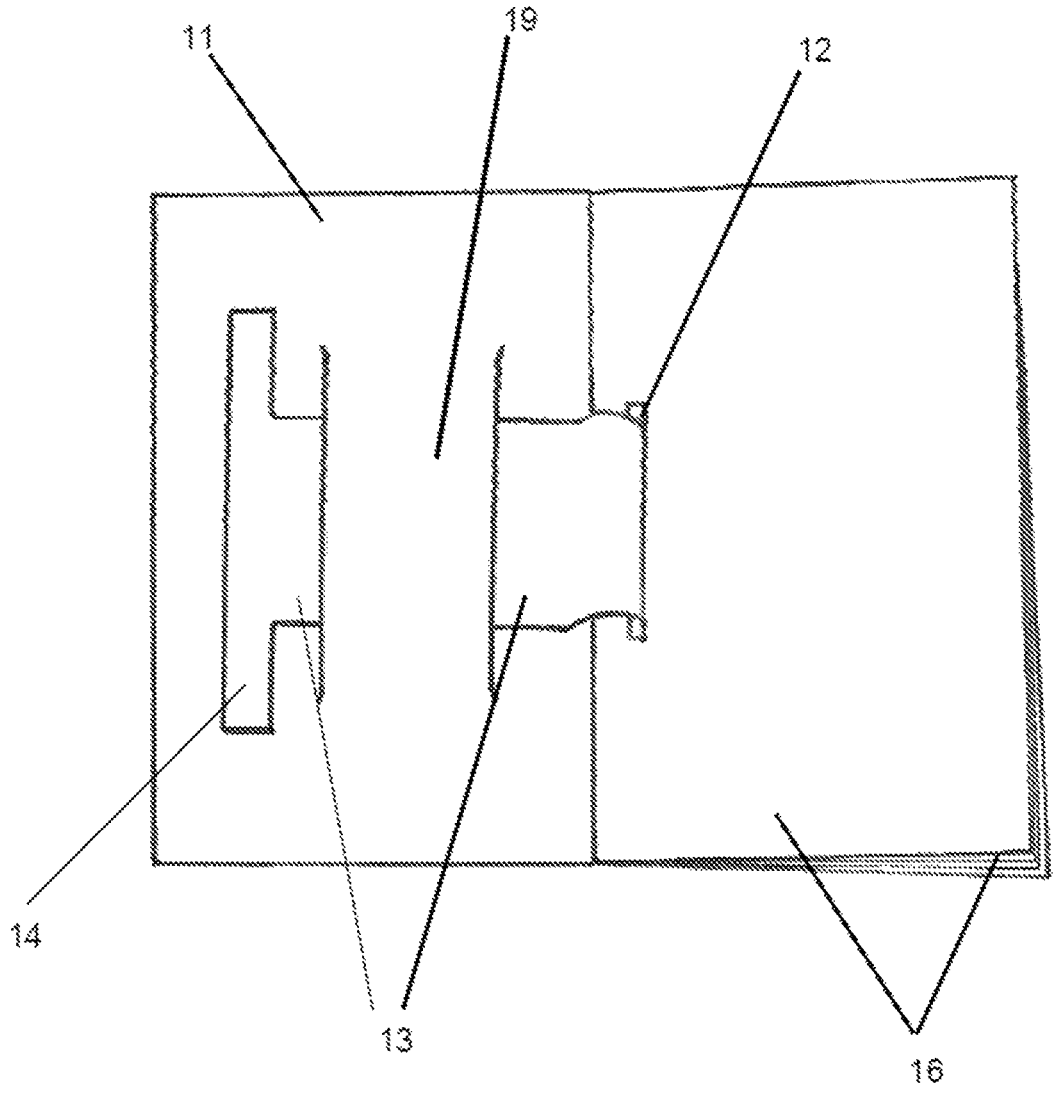
FIG. 5 shows the inside of the front cover of a book bound by a certain embodiment of the present invention.

FIG. 5 shows another embodiment where the strip is affixed to the inside of the front cover. After being thread through the space 12 in the sheets 16, the strip 13 is threaded through a sleeve 19 on the inside of the front cover 11. The strip 13 widens in width 14 such that it is prevented from slipping back through the sleeve 19 in the cover and thereby binds the pages and covers together. In some aspects, this mechanism can be exposed to the user. In other aspects, it may be covered or protected. Just one, but not all, examples for how this mechanism might be covered or protected is to adhere a piece of paper or cardboard over it.

Figure 6:
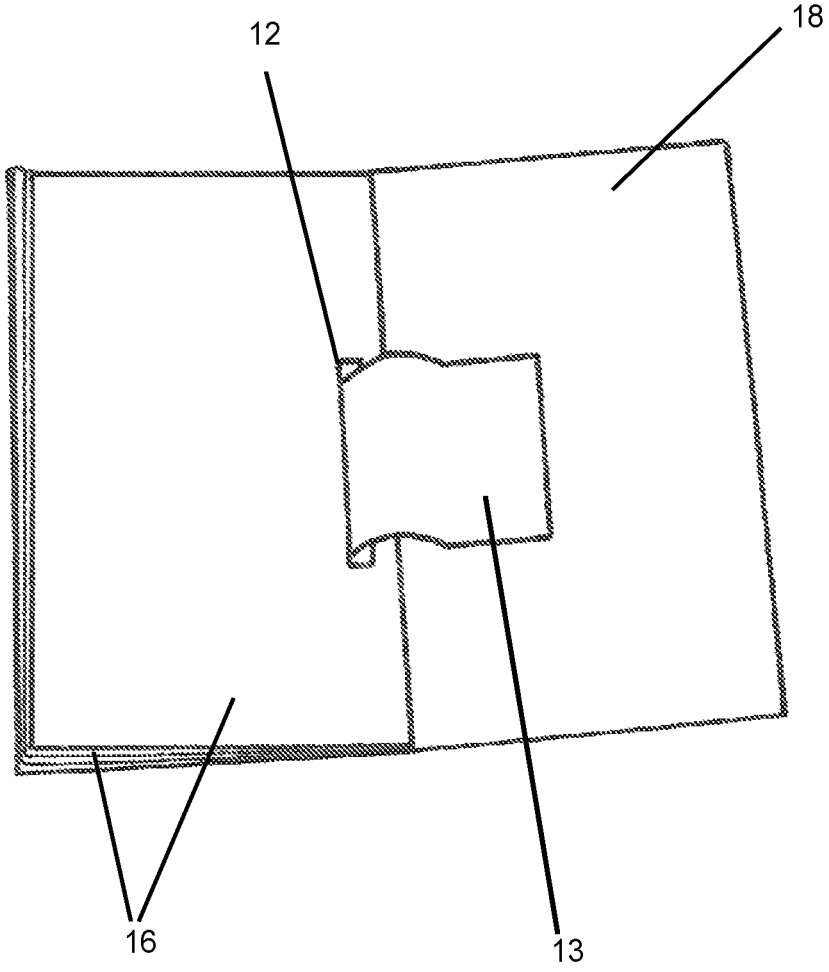
FIG. 6 shows the inside of the back cover of a book bound by a certain embodiment of the present invention.

FIG. 6 shows the inside of the back cover of a book bound by a certain embodiment of the present invention. In this embodiment, the flexible strip 13 is affixed to the back cover 18 and can be seen to thread through a space 12 in the sheets 16.

In certain embodiments, the strip can be made to temporarily bind the sheets and covers, allowing for the sheets to be replaced or refilled. There are several ways by which this could be accomplished. As an example, after being thread through the front cover, the strip is affixed in the rolled position by using Velcro. To replace sheets within the book, the user could unroll the strip, slide the front cover and current sheets off, slide on new sheets and the front cover, and then roll the strip back up.

In certain embodiments, the front and back covers can be connected. In certain embodiments, they can be connected along the longer edge, and in other embodiments they can be connected along the shorter edge. In certain embodiments, they can be connected along the entirety of the edge, and in other embodiments they can be connected along only a portion or portions of the edge. In certain embodiments, they can be connected with the same material as the covers, and in other embodiments the front and back covers could be connected by a different material including, but not limited to, an elastic material.

Figure 10:
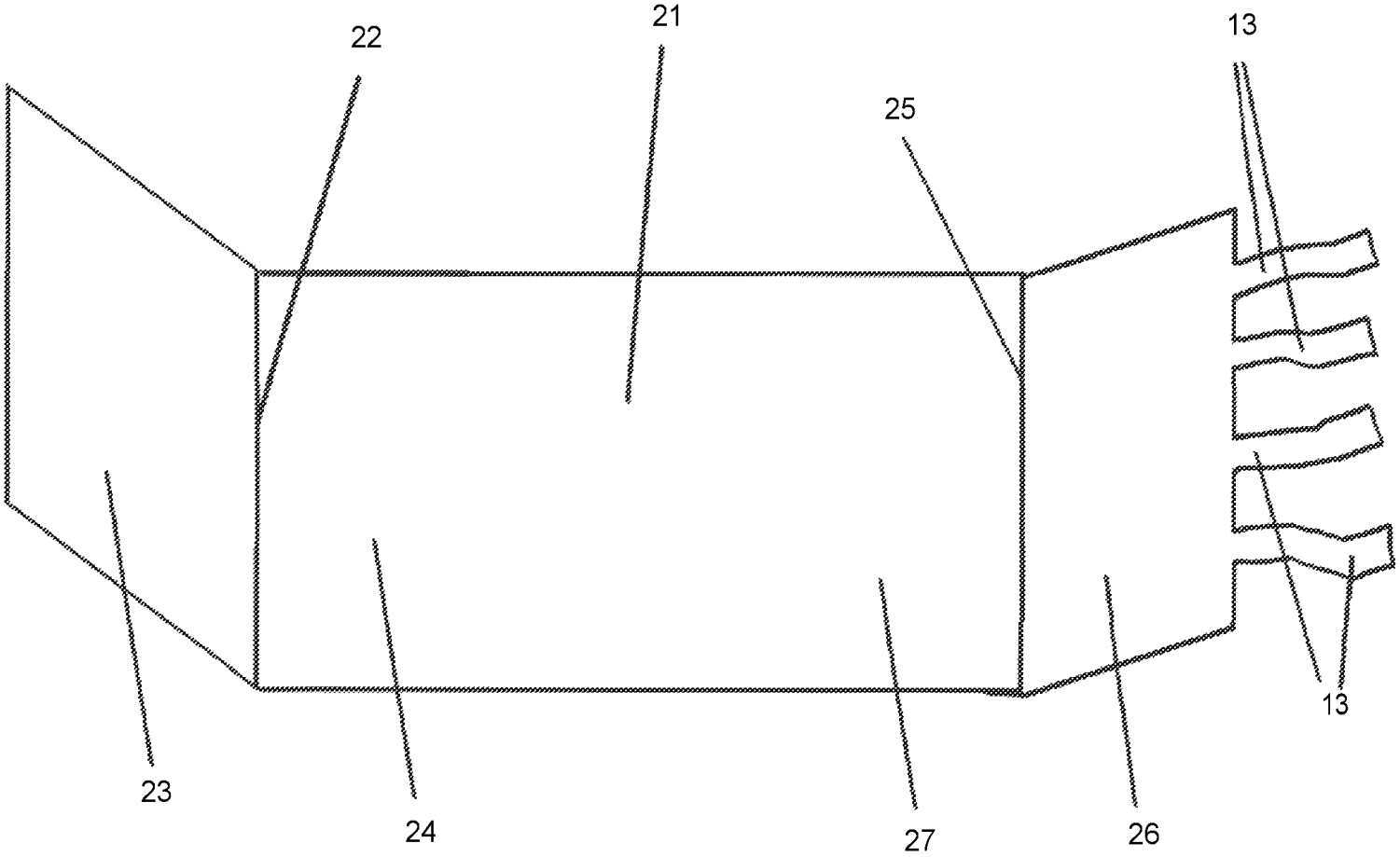
FIG. 10 shows certain elements of a deconstructed book of a certain embodiment of the present invention.
Figure 11:
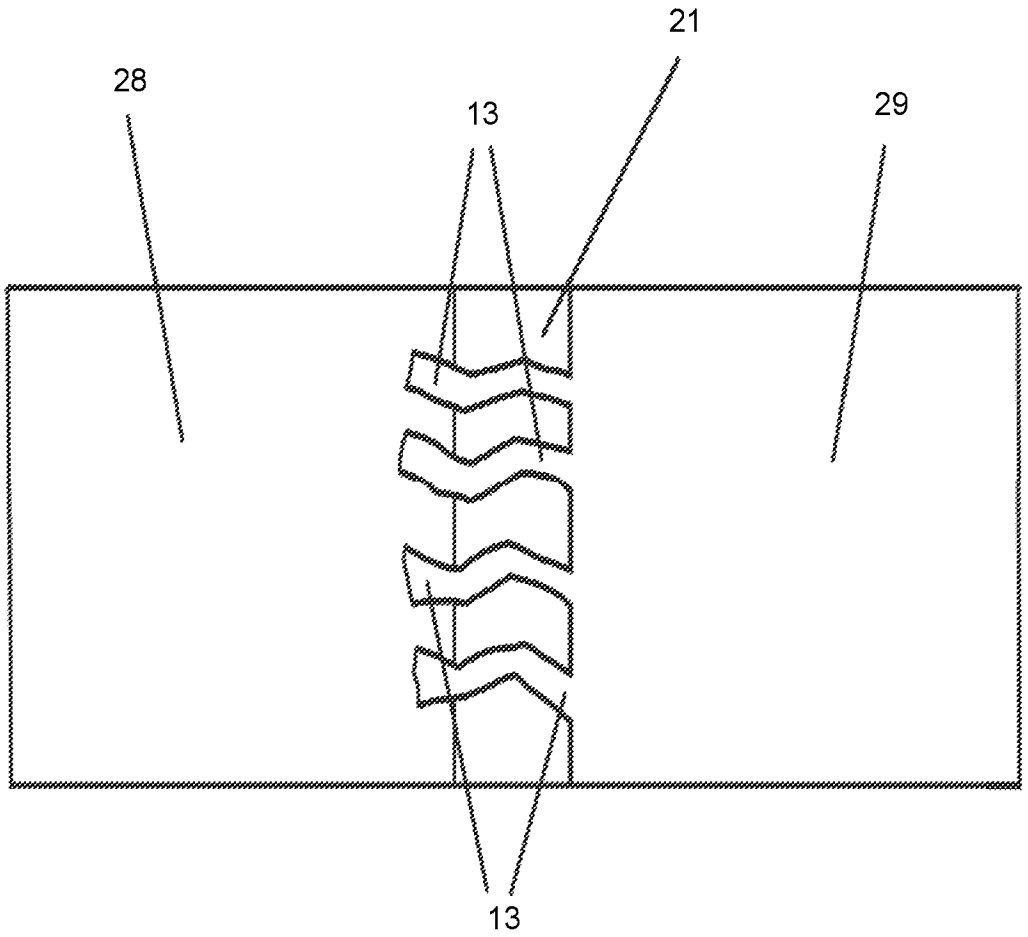
FIG. 11 shows certain elements of a partially constructed book of a certain embodiment of the present invention.
Figure 12:
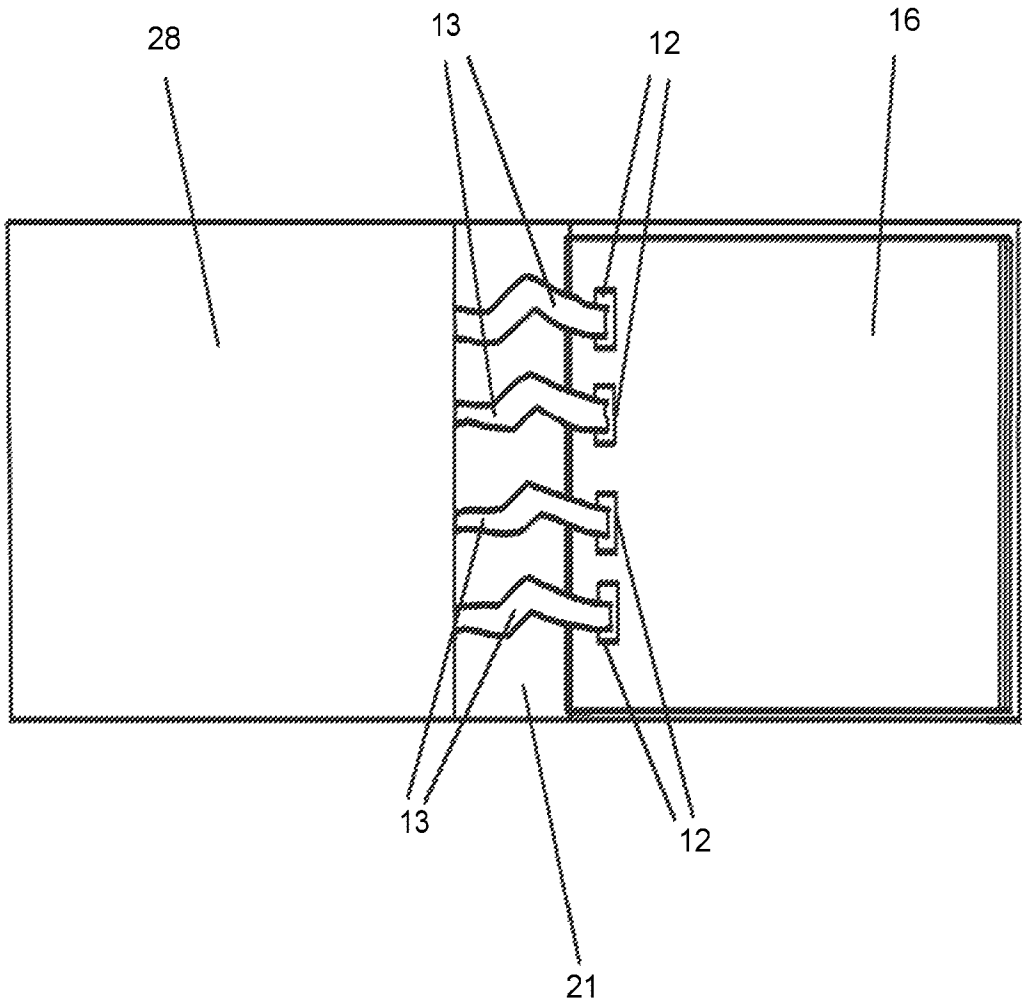
FIG. 12 shows the inside of the front cover of a book bound by a certain embodiment of the present invention.

FIGS. 10-12 show one example of how a book of a certain embodiment of the present invention can be made. FIG. 10 shows a view of certain elements of a deconstructed book of a certain embodiment of the present invention. In this embodiment, the front cover, spine, back cover, and flexible strips are all made out of a single sheet of material. Such a shape could be easily made via die cutting, among other possibilities. To construct a book of this embodiment, start with a single sheet of material as seen in FIG. 10. The inside surface of the top layer of the front cover 23 can be folded along the front cover fold line 22 to adhere to the inside surface of the bottom layer of the front cover 24. The two layers of the front cover may be adhered via an adhesive or via sewing, among many other possibilities. Then, the inside surface of the top layer of the back cover 26 can be folded along the back cover fold line 25 to adhere to the inside surface of the bottom layer of the back cover 27. The two layers of the back cover may be adhered via an adhesive or via sewing, among many other possibilities. In some instances, it might be desirable to insert a piece of chipboard or other material between the layers of the front and/or back covers to add more thickness or structure to the book. Upon completion of those steps, the book should resemble FIG. 11. FIG. 11 shows the outside surface of the top layer of the front cover 28, the outside surface of the top layer of the back cover 29, and the flexible strips 13 before sheets have been added and they have been finally bound. FIG. 11 also shows how the spine 21 of the book has been formed in this construction. After threading sheets through the flexible strips 13 and then adhering or binding the flexible strips to the front cover (via an adhesive or sewing, among many other possibilities), the book will resemble FIG. 12. In FIG. 12 one can see that the flexible strips 13 have threaded through the sheets 16 via the space in the sheets 12 to bind the sheets and covers together. FIG. 12 also shows the outside surface of the top layer of the front cover 28 and the spine 21.

In certain embodiments, the flexible strip can be elastic, and in other embodiments it will be inelastic. In certain embodiments, there will be one flexible strip, and in other embodiments there will be two or three or even more flexible strips. FIGS. 1, 2, 3, 5, 6, 7, 8, and 12 show a space 12 that is rectangular. In some embodiments, the space where the strip is threaded can be rectangular, and in other embodiments it can be circular, oval, stadium (a rectangle with a pair of semi-circles positioned at opposite ends), or other shapes. In still further aspects, the space 12 can be an ornamental design or shape. In some aspects, the sheets can be waterproof and/or tear resistant. In some aspects, there can be a pocket on the inside or outside of the front or back covers. In some aspects, the first and/or last sheet will be made with a material that is more durable than the other sheets.

It is important that the sheets be able to be turned backward and forward easily. Therefore, in some embodiments the length of the strip is important, as too short a length may cause the sheets to be too tight, and too long a length may cause the sheets to become disorganized. In some embodiments, the preferred length of the strip will correspond to the thickness of the sheets when they are stacked together or compiled. In some embodiments, the length of the flexible strip or strips, between where they are secured at the front and back covers, will be preferred to be between about 2 times to about 25 times the thickness of the compiled sheets.

INCORPORATION BY REFERENCE

The entire disclosure of each of the patent documents, including certificates of correction, patent application documents, scientific articles, governmental reports, websites, and other references referred to herein is incorporated by reference herein in its entirety for all purposes. In case of a conflict in terminology, the present specification controls.

EQUIVALENTS

The invention can be embodied in other specific forms without departing from the spirit or essential characteristics thereof. The foregoing embodiments are to be considered in all respects illustrative rather than limiting on the invention described herein. In the various embodiments of the methods and systems of the present invention, where the term comprises is used with respect to the recited steps of the methods or components of the manufactures, it is also contemplated that the methods and manufactures consist essentially of, or consist of, the recited steps or components. Furthermore, it should be understood that the order of steps or order for performing certain actions is immaterial so long as the invention remains operable. Moreover, two or more steps or actions can be conducted simultaneously.

In the specification, the singular forms also include the plural forms, unless the context clearly dictates otherwise. Unless defined otherwise, all technical and scientific terms used herein have the same meaning as commonly understood by one of ordinary skill in the art to which this invention belongs. In the case of conflict, the present specification will control.

What is claimed is:

1. A flexible book, comprising:

(a) a flexible front cover having an inner surface and an outer surface;

(b) a flexible rear cover having an inner surface and an outer surface;

(c) one or more flexible strips, each flexible strip extending from the inner surface of the front cover to the inner surface of the rear cover;

(d) a plurality of interior sheets, each comprising one or more apertures, such that the one or more apertures are each identically oriented on each sheet; and (e) a flexible spine formed together with the front cover, the rear cover, and the one or more flexible strips as a single sheet of material;

wherein, the one or more flexible strips have a length, between the front and back covers, greater than a collective thickness of the interior sheets, wherein each strip is threaded through and moves freely through an identically oriented group of apertures of the one or more sheets, and wherein the book is flexible about an axis perpendicular to the spine permitting at least one inch of deflection in fore and aft directions.

2. A book according to claim 1, wherein each of the plurality of interior sheets comprises at least three apertures, each of the apertures aligned with corresponding apertures on the other of the plurality of interior sheets.

3. A book according to claim 1 wherein the length of the flexible strips is 3 times to 15 times the thickness of the compiled interior sheets.

4. A book according to claim 3 wherein the length of the flexible strips is 4 times to 10 times the thickness of the compiled interior sheets.

5. A book according to claim 1 wherein the one or more flexible strips each comprises one or more folds, which when the book is opened are oriented at a 90 degree angle to the longitudinal direction of each strip and the one or more folds are identically positioned and oriented on each strip.

6. A book according to claim 1, wherein the front cover includes a fold line in the single sheet of material at a distal edge of the front cover between the inner and outer surfaces of the front cover.

7. A book according to claim 6, wherein the rear cover includes a fold line in the single sheet of material at a distal edge of the rear cover between the inner and outer surfaces of the rear cover.

8. A book according to claim 7, wherein the outer surface of the front cover is adhered to the inner surface of the front cover, and the outer surface of the rear cover is adhered to the inner surface of the rear cover.

9. A book according to claim 7, further comprising a first layer between the inner and outer surfaces of the front cover, and a second layer between the inner and outer surfaces of the rear cover.

* * * * *